US011667003B2

(12) United States Patent
Fukushi et al.

(10) Patent No.: US 11,667,003 B2
(45) Date of Patent: Jun. 6, 2023

(54) PROCESSING APPARATUS

(71) Applicant: DISCO CORPORATION, Tokyo (JP)

(72) Inventors: Nobuyuki Fukushi, Tokyo (JP); Tetsuo Kubo, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 55 days.

(21) Appl. No.: 17/393,908

(22) Filed: Aug. 4, 2021

(65) Prior Publication Data

US 2022/0055173 A1 Feb. 24, 2022

(30) Foreign Application Priority Data

Aug. 24, 2020 (JP) ..... JP2020-140808

(51) Int. Cl.
*B24B 7/22* (2006.01)
*B24B 41/06* (2012.01)

(52) U.S. Cl.
CPC ..... *B24B 7/228* (2013.01); *B24B 41/06* (2013.01)

(58) Field of Classification Search
CPC ..... B24B 7/228; B24B 7/04; B24B 41/06; B24B 37/04; B24B 37/042; B24B 37/07; B24B 37/10; B24B 37/107; B24B 37/345; B24B 37/27; B24B 37/30
USPC ..... 451/5
See application file for complete search history.

(56) References Cited

FOREIGN PATENT DOCUMENTS

| | | | |
|---|---|---|---|
| JP | 2007294588 A | | 11/2007 |
| JP | 2009076720 A | | 4/2009 |
| JP | 2013145776 A | * | 7/2013 |

OTHER PUBLICATIONS

Search Report issued in corresponding Singapore patent application No. 10202108472S, dated Jul. 17, 2022.

* cited by examiner

*Primary Examiner* — Brian D Keller
*Assistant Examiner* — Robert C Moore
(74) *Attorney, Agent, or Firm* — Greer Burns & Crain, Ltd.

(57) ABSTRACT

A wafer held on a delivery pad is lifted from a holding surface, and when a lower surface of the wafer has been spaced in its entirety from the holding surface, an air flow rate regulating valve is opened to eject air from the holding surface. As the distance between the holding surface and the wafer spaced from the holding surface increases by lifting of a delivery unit, the degree of opening of the air flow rate regulating valve is adjusted to increase a flow rate of air from the holding surface, thereby spacing the wafer from the holding surface in a short period of time without rupturing the wafer.

1 Claim, 3 Drawing Sheets

PROCESSING APPARATUS

BACKGROUND OF THE INVENTION

Field of the Invention

The present invention relates to a processing apparatus.

Description of the Related Art

As disclosed in Japanese Patent Laid-open No. 2007-294588, a processing apparatus for processing a wafer held on a holding surface operates to eject a mixed fluid including a mixture of water and air from the holding surface for separating the processed wafer from the holding surface with use of a delivery pad that holds the wafer.

SUMMARY OF THE INVENTION

However, the disclosed processing apparatus is problematic in that the wafer tends to be ruptured by the pressure of the mixed fluid ejected from the holding surface. To solve the above problem, there has been proposed an invention regarding a processing apparatus that gradually increases the amount of a mixed fluid ejected from a holding surface, as disclosed in Japanese Patent Laid-open No. 2009-076720. However, the proposed invention is disadvantageous in that it takes time to separate a processed wafer from the holding surface.

It is therefore an object of the present invention to provide a processing apparatus that is capable of separating a wafer from a holding surface in a short period of time without rupturing the wafer.

In accordance with an aspect of the present invention, there is provided a processing apparatus including a chuck table for holding a lower surface of a wafer on a holding surface thereof, a processing unit for processing an upper surface of the wafer whose lower surface is held on the holding surface, a delivery unit for unloading, from the holding surface, the wafer held on the holding surface, and a control unit. In the processing apparatus, the chuck table includes a fluid communication passage providing fluid communication between the holding surface and a water supply source, a branching portion included in the fluid communication passage, an air fluid communication passage providing air fluid communication between the branching portion and an air supply source, a water flow rate regulating valve disposed in the fluid communication passage between the holding surface and the water supply source, for regulating a flow rate of water from the water supply source, and an air flow rate regulating valve disposed in the air fluid communication passage, for regulating a flow rate of air from the air supply source. The control unit controls the delivery unit to hold the wafer held on the holding surface, opens the water flow rate regulating valve to eject water from the holding surface, spaces the wafer from the holding surface and lifts the delivery unit holding the wafer, from the holding surface, with the water ejected from the holding surface, opens the air flow rate regulating valve to eject air from the holding surface when the lower surface of the wafer has been spaced in its entirety from the holding surface, and increases the flow rate of air as a distance between the holding surface and the wafer spaced from the holding surface increases by lifting of the delivery unit.

According to the present invention, it is possible to space a wafer quickly from a holding surface without rupturing the wafer, with use of a delivery unit, resulting in an increase in productivity.

The above and other objects, features and advantages of the present invention and the manner of realizing them will become more apparent, and the invention itself will best be understood from a study of the following description and an appended claim with reference to the attached drawings showing a preferred embodiment of the invention.

DETAILED DESCRIPTION OF THE PREFERRED EMBODIMENT

Figure 1:
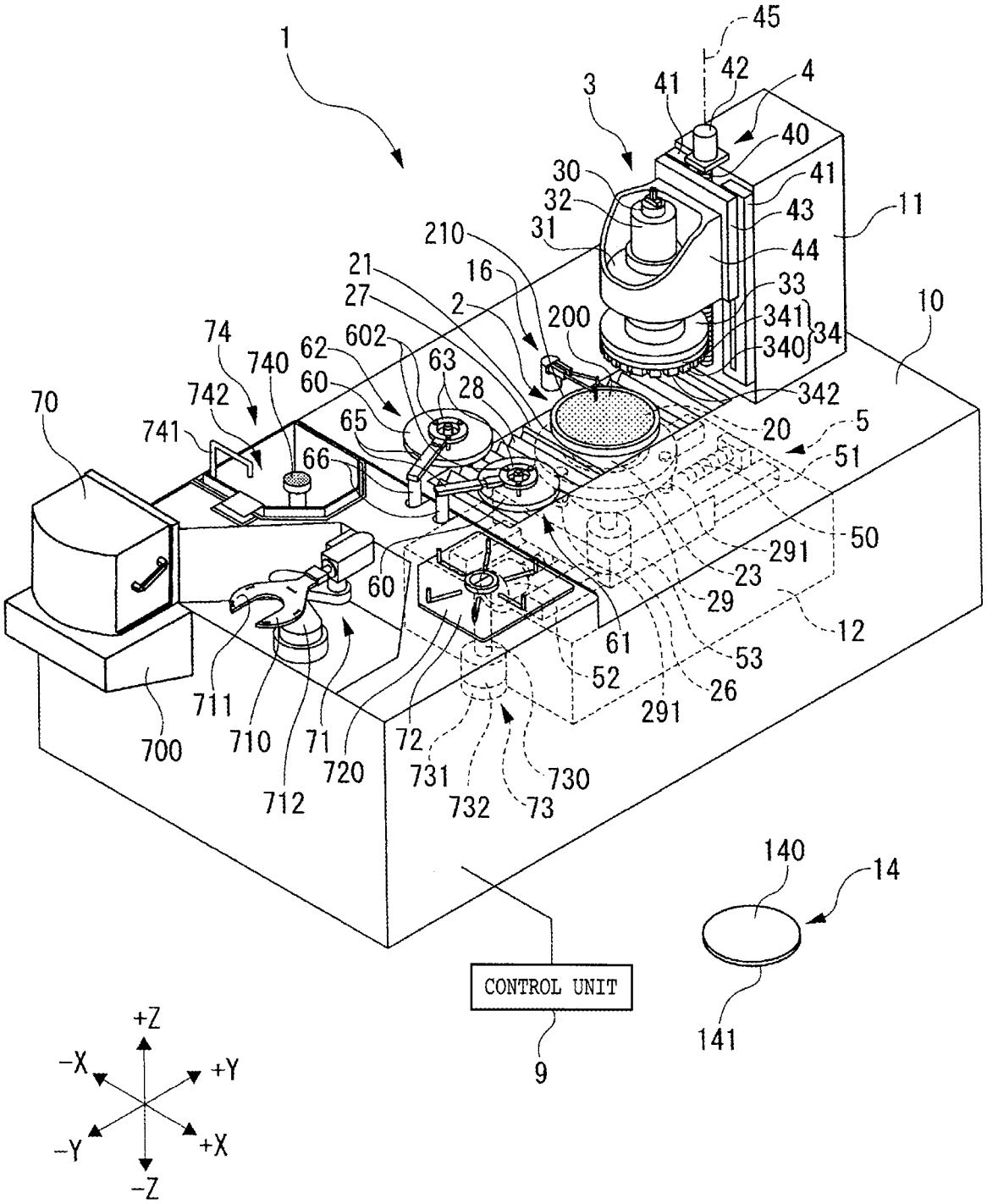
FIG. 1 is a perspective view illustrating a processing apparatus according to an embodiment of the present invention in its entirety.

As illustrated in FIG. 1, a processing apparatus 1 according to an embodiment of the present invention is illustrated as a grinding apparatus including a processing unit 3 for processing an upper surface 140 of a wafer 14 held on a holding surface 200. The wafer 14 is made of silicon carbide (SiC), for example, and has a thickness of approximately 2 cm before it is processed. Structural details of the processing apparatus 1 will be described hereinbelow. The processing apparatus 1 will be described in relation to a three-dimensional coordinate system including X, Y, and Z axes extending respectively along X-axis, Y-axis, and Z-axis directions. The X-axis directions extend horizontally and include +X and −X directions, and the Y-axis directions extend horizontally perpendicularly to the X-axis directions and include +Y and −Y directions. The Z-axis directions extend vertically perpendicularly to the X-axis directions and the Y-axis directions and include +Z and −Z directions.

As illustrated in FIG. 1, the processing apparatus 1 includes a base 10 extending in the Y-axis directions and a column 11 erected in the +Z direction on an end portion of the base 10 in the +Y direction. The processing apparatus 1 also includes a processing feed mechanism 4 mounted on a side face of the column 11 that faces in the −Y direction. The processing unit 3 is vertically movably supported on the processing feed mechanism 4. The processing unit 3 includes a grinding unit including, for example, a spindle 30 having a central axis extending vertically in the Z-axis directions, a housing 31 on which the spindle 30 is rotatably supported, a spindle motor 32 coupled to the spindle 30 for rotating the spindle 30 about the central axis thereof, a mount 33 connected to a lower end of the spindle 30, and a grinding wheel 34 detachably mounted on a lower surface of the mount 33.

The grinding wheel 34 includes a wheel base 341 and an annular array of grindstones 340, each in the shape of a substantially rectangular parallelepiped, disposed on a lower surface of the wheel base 341. The grindstones 340 have respective lower surfaces that jointly make up a grinding surface 342 for contacting the wafer 14.

When the spindle motor 32 is energized, it rotates the spindle 30 about its central axis, rotating the mount 33 connected to the spindle 30 and the grinding wheel 34 mounted on the lower surface of the mount 33 in unison with each other.

The processing feed mechanism 4 includes a ball screw 40 having a rotational axis 45 extending vertically in the Z-axis directions, a pair of guide rails 41 being disposed on both sides of the ball screw 40 and extending parallel thereto, a Z-axis motor 42 coupled to the ball screw 40 for rotating the ball screw 40 about the rotational axis 45, a lifting and lowering plate 43 having therein an unillustrated nut operatively threaded over the ball screw 40 and side portions held in sliding contact with the guide rails 41, and a holder 44 being coupled to the lifting and lowering plate 43 and supporting the processing unit 3.

When the Z-axis motor 42 is energized, it rotates the ball screw 40 about the rotational axis 45, causing the lifting and lowering plate 43 to move vertically in the Z-axis directions while being guided by the guide rails 41 and moving the grinding wheel 34 of the processing unit 3 held by the holder 44, vertically in the Z-axis directions.

A holding unit 2 is disposed on the base 10. The holding unit 2 includes a chuck table for holding the wafer 14 thereon, for example. The holding unit 2 includes a suction member 20 shaped as a circular plate and a frame 21 supporting the suction member 20. The suction member 20 includes a porous member, for example, having a number of pores therein. The suction member 20 has an upper surface acting as a holding surface 200 for holding a lower surface 141 of the wafer 14 thereon. The frame 21 has an upper surface 210 lying flush with the holding surface 200.

The base 10 has an inner base 12 disposed therein. A horizontal moving mechanism 5 for moving the holding unit 2 horizontally is disposed on the inner base 12.

The horizontal moving mechanism 5 includes a ball screw 50 having a rotational axis extending in the Y-axis directions, a pair of guide rails 51 being disposed on both sides of the ball screw 50 and extending parallel thereto, a Y-axis electric motor 52 coupled to the ball screw 50 for rotating the ball screw 50 about the rotational axis, and a movable plate 53 having a nut disposed on a bottom surface thereof and operatively threaded over the ball screw 50, the movable plate 53 being movable along the guide rails 51 in the Y-axis directions. When the Y-axis electric motor 52 is energized, it rotates the ball screw 50 about the rotational axis, causing the movable plate 53 to move horizontally in the Y-axis directions while being guided by the guide rails 51.

Figure 2:
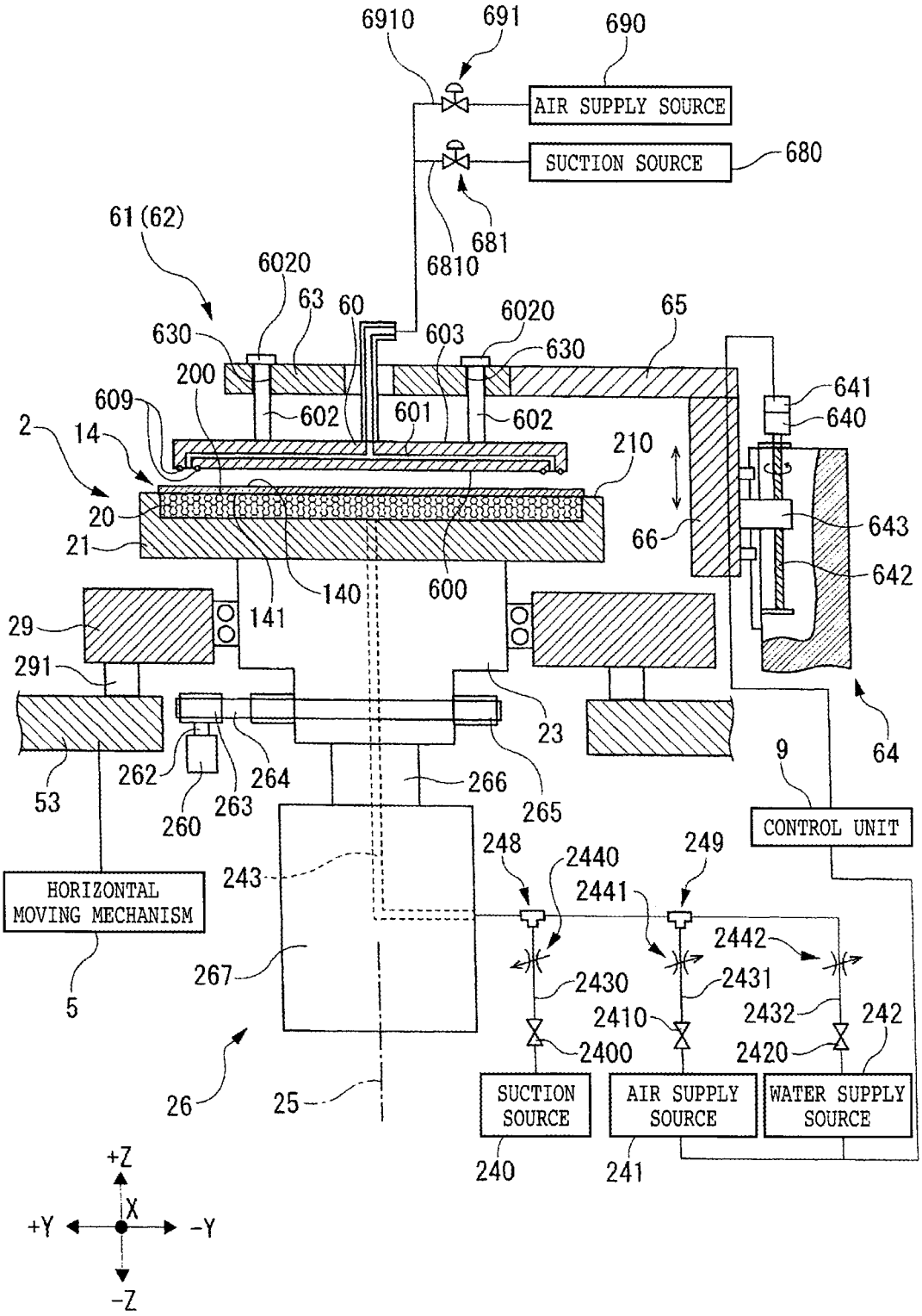
FIG. 2 is a cross-sectional view, partly in block form, of a delivery unit and a holding unit of the processing apparatus.

A plurality of (two in FIG. 1) support posts 291 are erected on the movable plate 53 and support an annular joint member 29 thereon. A base table 23 is rotatably supported on the annular joint member 29. As illustrated in FIG. 2, the holding unit 2 is mounted on the base table 23 with the frame 21 supported on the base table 23. In other words, the holding unit 2 is disposed on the movable plate 53 with the support posts 291, the joint member 29, and the base table 23 interposed therebetween.

A rotary unit 26 for rotating the base table 23 about its vertical central axis is disposed below the holding unit 2. The rotary unit 26 includes a pulley mechanism, for example, and includes a drive shaft 262 rotatable about a vertical central axis along the Z-axis directions by an electric motor 260, a drive pulley 263 coupled to an upper end of the drive shaft 262, an endless transmission belt 264 trained around the drive pulley 263 and a driven pulley 265, for transmitting drive power from the drive pulley 263 to the driven pulley 265, a driven shaft 266 to which the driven pulley 265 is connected, and a rotary joint 267 coupled to a lower end of the driven shaft 266. The driven shaft 266 is coupled to the base table 23.

When the electric motor 260 is energized to rotate the drive shaft 262 about its vertical central axis, the drive pulley 263 is rotated in unison with the drive shaft 262, causing the transmission belt 264 to transmit drive power from the drive pulley 263 to the driven pulley 265 and rotating the driven pulley 265. The driven shaft 266 connected to the driven pulley 265 is thus rotated about a vertical rotational axis 25 extending in the Z-axis directions, rotating the base table 23 coupled to the driven shaft 266 about the vertical rotational axis 25.

A suction source 240, an air supply source 241, and a water supply source 242 are disposed below the holding unit 2. The holding unit 2 includes a fluid communication passage 243 that provides fluid communication between the holding surface 200 and the water supply source 242. The fluid communication passage 243 extends through the frame 21, the base table 23, the driven shaft 266, and the rotary joint 267, for example, and protrudes out of the rotary joint 267 from a side surface thereof.

The fluid communication passage 243 has a first branching portion 248 and a second branching portion 249 and is branched from the first branching portion 248 and the second branching portion 249 into a suction fluid communication passage 2430, an air fluid communication passage 2431, and a water fluid communication passage 2432. The suction fluid communication passage 2430 provides fluid communication between the first branching portion 248 and the suction source 240. The air fluid communication passage 2431 provides fluid communication between the second branching portion 249 and the air supply source 241. The water fluid communication passage 2432 provides fluid communication between the second branching portion 249 and the water supply source 242.

A suction valve 2400 and a suction force regulating valve 2440 are connected between the first branching portion 248 and the suction source 240. When the suction source 240 is actuated while the suction valve 2400 is open, a suction force generated by the suction source 240 is transmitted through the fluid communication passage 243 to the holding surface 200 of the suction member 20.

For example, when the suction valve 2400 is opened and the suction source 240 is actuated while the wafer 14 is placed on the holding surface 200, the wafer 14 is held under suction on the holding surface 200 by the suction force from the suction source 240. The intensity of the suction force transmitted to the holding surface 200 can be regulated by adjusting the restriction provided by the suction force regulating valve 2440.

An air valve 2410 and an air flow rate regulating valve 2441 are connected between the second branching portion 249 and the air supply source 241. When the air supply source 241 is actuated to supply air while the air valve 2410 is open, the supplied air is transmitted through the fluid communication passage 243 to the suction member 20 and ejected through the pores in the holding surface 200 into a space above the holding surface 200. The flow rate of the air ejected from the holding surface 200 can be regulated by adjusting the restriction provided by the air flow rate regulating valve 2441.

A water valve 2420 and a water flow rate regulating valve 2442 are connected between the second branching portion 249 and the water supply source 242. When the water supply source 242 supplies water while the water valve 2420 is open, the supplied water is transmitted through the fluid communication passage 243 to the suction member 20 and ejected from the pores in the holding surface 200. The flow rate of the water ejected from the holding surface 200 can be regulated by adjusting the restriction provided by the water flow rate regulating valve 2442.

As illustrated in FIG. 1, for example, a cover 27 and a bellows 28 that is stretchably and contractibly coupled to the cover 27 are disposed in the base 10 and coupled to the holding unit 2. When the holding unit 2 is moved in the Y-axis directions, the cover 27 is also moved in the Y-axis directions in unison with the holding unit 2, stretching and contracting the bellows 28.

A cassette stage 700 is attached to an end surface of the base 10 that faces in the −Y direction. A cassette 70 is placed on the cassette stage 700. The cassette 70 houses a plurality of wafers 14 to be ground, for example, and also houses wafers 14 that have been ground.

A robot 71 is mounted on the base 10 at a position close to but spaced from the cassette 70 on the cassette stage 700 in the +X direction and the +Y direction. The robot 71 has a robot hand 710 and a rotatable shaft 712 on which the robot hand 710 is swiveled. The robot hand 710 has a holding surface 711 as an upper surface connected to a suction source, not shown. When the suction source is actuated, the holding surface 711 can hold a wafer 14 under suction thereon.

When the robot 71 is in operation, it removes a wafer 14 to be ground from the cassette 70 and holds the wafer 14 under suction on the holding surface 711 of the robot hand 710. The shaft 712 is rotated to turn the robot hand 710, take out the wafer 14 from the cassette 70, and deliver the wafer 14 to a temporary rest area 720 on the base 10 adjacent to the robot 71.

The temporary rest area 720 where the wafer 14 to be ground is temporarily held at rest is positioned within a movable range of the robot 71 near an end area of the movable range in the +X direction. A cleaning area 742 for cleaning a wafer 14 that has been ground is positioned on the base 10 within the movable range of the robot 71 near an opposite end area of the movable range in the −X direction.

A positioning mechanism 72 is disposed in the temporary rest area 720. The positioning mechanism 72 is connected to a rotary unit 73 including a rotational shaft 730, an encoder 731, and an electric motor 732 that are disposed in the base 10. The positioning mechanism 72 is rotatable about a central axis extending vertically in the Z-axis directions by the rotary unit 73. The wafer 14 taken out of the cassette 70 and placed on the temporary rest area 720 is aligned with a predetermined position by the positioning mechanism 72.

Spinner cleaning means 74 is disposed in the cleaning area 742. The spinner cleaning means 74 includes a spinner table 740 for holding a wafer 14 thereon and a cleaning fluid supply nozzle 741 for ejecting a cleaning fluid to the wafer 14 held on the spinner table 740. The spinner table 740 is rotatable about a central axis extending vertically in the Z-axis directions by an unillustrated rotary unit connected to the spinner table 740.

When the spinner cleaning means 74 is in operation, a wafer 14 that has been ground is held on the upper surface of the spinner table 740, and then the spinner table 740 is rotated about its vertical central axis while at the same time the cleaning fluid supply nozzle 741 supplies the cleaning fluid to the wafer 14 to clean the wafer 14.

A first delivery unit 61 for loading the wafer 14 positioned in the temporary rest area 720 onto the holding surface 200 of the holding unit 2 is disposed on the base 10 at a position adjacent to the temporary rest area 720. The first delivery unit 61 includes a circular delivery pad 60 for holding the upper surface 140 of the wafer 14 under suction thereon. The delivery pad 60 has an air flow channel 601 (see FIG. 2) defined therein. The air flow channel 601 is defined in an annular shape within the delivery pad 60 and has ends open at a lower surface 600 of the delivery pad 60 into a space outside of the delivery pad 60.

The air flow channel 601 leads to an air flow passage extending upwardly out of the delivery pad 60 and being branched into an air supply passage 6910 and a suction passage 6810. The air supply passage 6910 is connected to an air supply source 690 whereas the suction passage 6810 is connected to a suction source 680. The air supply passage 6910 has an air valve 691 connected thereto, and the suction passage 6810 has a suction valve 681 connected thereto.

Two O-rings 609 having different diameters are disposed on the lower surface 600 of the delivery pad 60 near an outer circumferential edge thereof in respective positions that are spaced radially inwardly and outwardly from the openings of the air flow channel 601 in the lower surface 600. The O-rings 609 function as sealing members that are held in intimate contact with the upper surface 140 of the wafer 14 to keep the wafer 14 firmly on the delivery pad 60 when the wafer 14 is held under suction on the delivery pad 60.

When the air valve 691 is open, the air supply source 690 is operated to supply air through the air flow channel 601 to the openings thereof in the lower surface 600, from which the air is ejected downwardly. When the air valve 691 is closed and the suction valve 681 is open, the suction source 680 is operated to produce a suction force that is transmitted through the air flow channel 601 to the openings thereof in the lower surface 600 of the delivery pad 60.

While the upper surface 140 of the wafer 14 is being held in contact with the lower surface 600 of the delivery pad 60, the suction force produced by the suction source 680 and transmitted through the air flow channel 601 to the openings thereof in the lower surface 600 of the delivery pad 60 acts on the wafer 14, attracting the wafer 14 under suction to the lower surface 600 of the delivery pad 60.

Three (two illustrated in FIG. 2) support rods 602 are fixed to an upper surface 603 of the delivery pad 60. The support rods 602 extend vertically in the Z-axis directions and have respective flanges 6020 on their upper ends. The support rods 602 extend through respective through holes 630 defined in a joint member 63, so that the flanges 6020 are supported on the joint member 63.

The joint member 63 is coupled to an end of an arm 65 whose other end is coupled to an upper end of a shaft 66 erected vertically in the Z-axis directions. The shaft 66 is connected to an unillustrated rotary unit and can be rotated about a central axis extending vertically in the Z-axis directions by the rotary unit. When the rotary unit rotates the shaft 66 about its vertical central axis, the arm 65 is turned to angularly move the delivery pad 60 between the temporary rest area 720 and the holding surface 200 of the suction member 20.

The shaft 66 is supported on a lifting and lowering mechanism 64. The lifting and lowering mechanism 64 includes a ball screw 642 extending vertically in the Z-axis directions, an electric motor 640 connected to an upper end of the ball screw 642 for rotating the ball screw 642 about a vertical central axis extending in the Z-axis directions, an encoder 641 for controlling the angular displacement of the electric motor 640, and a movable member 643 that is vertically movable in the Z-axis directions by an unillustrated nut that is disposed therein and that is operatively threaded over the ball screw 642. The movable member 643 is coupled to the shaft 66.

When the electric motor 640 is energized to rotate the ball screw 642 about its vertical central axis, the movable member 643 is vertically moved in one of the Z-axis directions by the nut operatively threaded over the ball screw 642, thereby moving the shaft 66 coupled to the movable member 643, the arm 65 coupled to the shaft 66, and the delivery pad 60 supported on the arm 65 in unison with each other vertically in the same Z-axis direction.

As illustrated in FIG. 1, a second delivery unit 62 for unloading a wafer 14 that has been ground from the holding surface 200 into the cleaning area 742 is disposed on the base 10 at a position that is close to but spaced from the first delivery unit 61 in the −X direction. Since the second delivery unit 62 is structurally similar to the first delivery unit 61, some components of the second delivery unit 62 are denoted by reference characters identical to those of the first delivery unit 61 and will not be described in detail below.

A thickness measuring unit 16 is disposed on the base 10 in the vicinity of the holding unit 2. The thickness measuring unit 16 has a contact-type height gauge or the like, for example, and is capable of measuring the thickness of a wafer 14 on the holding unit 2 by bringing the height gauge into contact with the upper surface 140 of the wafer 14 and the upper surface 210 of the frame 21 and measuring the difference between the heights of the upper surface 140 and the upper surface 210 with the height gauge.

The processing apparatus 1 includes a control unit 9 that controls operation of the various components of the processing apparatus 1, as follows: For grinding a wafer 14 on the processing apparatus 1, the robot 71 illustrated in FIG. 1 takes the wafer 14 out of the cassette 70 on the cassette stage 700 and temporarily places the wafer 14 in the temporary rest area 720, after which the positioning mechanism 72 positions the wafer 14 into alignment with a predetermined position.

After the wafer 14 has been positioned by the positioning mechanism 72, the first delivery unit 61 loads the wafer 14 temporarily placed in the temporary rest area 720 onto the holding surface 200 of the holding unit 2. Specifically, the shaft 66 illustrated in FIG. 2 is rotated about its vertical central axis to turn the arm 65 until the delivery pad 60 is positioned above the wafer 14 temporarily placed in the temporary rest area 720.

Then, the lifting and lowering mechanism 64 lowers the delivery pad 60 in the −Z direction to bring the lower surface 600 of the delivery pad 60 into contact with the upper surface 140 of the wafer 14. While the upper surface 140 of the wafer 14 is in contact with the lower surface 600 of the delivery pad 60, the suction source 680 is actuated to generate and transmit a suction force to the lower surface 600 of the delivery pad 60, attracting and holding the wafer 14 under suction on the lower surface 600 of the delivery pad 60.

With the wafer 14 being held under suction on the lower surface 600 of the delivery pad 60, the arm 65 is turned to position the wafer 14 held under suction on the lower surface 600 of the delivery pad 60 into a position above the holding surface 200 of the holding unit 2. The delivery pad 60 is then lowered to place the wafer 14 onto the holding surface 200. While the wafer 14 is being placed on the holding surface 200, the suction valve 2400 is opened and the suction source 240 held in fluid communication with the holding surface 200 is actuated to generate and transmit a suction force to the holding surface 200, attracting and holding the wafer 14 under suction on the holding surface 200. Thereafter, the suction force applied from the suction source 680 and acting on the lower surface 600 of the delivery pad 60 is canceled, releasing the wafer 14 from the lower surface 600 of the delivery pad 60.

Next, the horizontal moving mechanism 5 illustrated in FIG. 1 is actuated to move the wafer 14 held on the holding surface 200 in the +Y direction and position the wafer 14 below the processing unit 3. Then, the rotary unit 26 illustrated in FIG. 2 is actuated to rotate the holding unit 2 about the rotational axis 25. The wafer 14 held on the holding surface 200 is now rotated about the rotational axis 25. In addition, the spindle motor 32 illustrated in FIG. 1 is actuated to rotate the grindstones 340.

While the wafer 14 held on the holding surface 200 is rotating and also the grindstones 340 are rotating, the processing feed mechanism 4 is actuated to lower the grindstones 340 in the −Z direction. The grinding surface 342 of the grindstones 340 is now brought into contact with the upper surface 140 of the wafer 14 held on the holding surface 200. While the grinding surface 342 of the grindstones 340 is in contact with the upper surface 140 of the wafer 14, the grindstones 340 are further lowered in the −Z direction, grinding the wafer 14. The thickness measuring unit 16 measures the thickness of the wafer 14 as it is being ground. When the wafer 14 has been ground to a predetermined thickness as measured by the thickness measuring unit 16, the process of grinding the wafer 14 comes to an end.

After the process of grinding the wafer 14 has ended, the processing feed mechanism 4 is actuated to lift the grindstones 340 in the +Z direction, spacing the grindstones 340 in the +Z direction away from the upper surface 140 of the wafer 14. Then, the horizontal moving mechanism 5 is actuated to move the wafer 14 held on the holding surface 200 in the −Y direction.

Thereafter, the second delivery unit 62 is actuated to unload the wafer 14 from the holding surface 200. Specifically, the control unit 9 controls the processing apparatus 1 to unload, from the holding surface 200, the wafer 14 held on the holding surface 200 with the second delivery unit 62, as follows: First, as illustrated in FIG. 2, the delivery pad 60 of the second delivery unit 62 is positioned above the wafer 14, and then lowered in the −Z direction by the lifting and lowering mechanism 64 until the lower surface 600 of the delivery pad 60 comes into contact with the upper surface 140 of the wafer 14. While the upper surface 140 of the wafer 14 is being held in contact with the lower surface 600 of the delivery pad 60, the suction source 680 is actuated to generate and transmit a suction force to the lower surface 600 of the delivery pad 60, attracting and holding the wafer 14 under suction on the lower surface 600 of the delivery pad 60.

The suction valve 2400 is closed to prevent the suction force generated by the suction source 240 from being transmitted to holding surface 200. Then, the water valve 2420 and the water flow rate regulating valve 2442 are opened to supply water from the water supply source 242 through the water fluid communication passage 2432 and the fluid communication passage 243 to the porous suction member 20, through which the water is ejected upwardly in the +Z direction from the holding surface 200.

When the water is ejected from the holding surface 200, the water forms a water film between the holding surface 200 and the lower surface 141 of the wafer 14, raising the delivery pad 60 that is holding the wafer 14 and hence spacing the wafer 14 from the holding surface 200. In other words, the holding surface 200 supports the delivery pad 60 that is holding the wafer 14 with the water film interposed therebetween. The flanges 6020 of support rods 602 are thus lifted off the joint member 63. At this stage, the water has spread fully over the holding surface 200, forming a water film entirely between the holding surface 200 and the lower surface 141 of the wafer 14.

In this state, the lifting and lowering mechanism 64 lifts the arm 65 in the +Z direction to cause the joint member 63 to bear the flanges 6020 and lift the delivery pad 60 that is holding the wafer 14 in the +Z direction from the holding surface 200.

When the joint member 63 has borne the flanges 6020, the air valve 2410 and the air flow rate regulating valve 2441 are opened to supply air from the air supply source 241 through the air fluid communication passage 2431 into the fluid communication passage 243 where the air is mixed with the water from the water supply source 242. The air and the water that are mixed together is supplied as a mixed fluid through the fluid communication passage 243 to the porous suction member 20, through which the mixed fluid is ejected upwardly in the +Z direction from the holding surface 200.

Even after the lower surface 141 of the wafer 14 has been spaced in its entirety from the holding surface 200, the lifting and lowering mechanism 64 lifts the wafer 14 held on the delivery pad 60 in the +Z direction. As the distance between the holding surface 200 and the wafer 14 spaced from the holding surface 200 increases, the opening of the air flow rate regulating valve 2441 is progressively increased in a manner commensurate with the increasing distance, thereby increasing the amount of air ejected from the holding surface 200. By thus introducing the air into the water film formed in the clearance between the holding surface 200 and the lower surface 141 of the wafer 14, the surface tension of the water film is broken, allowing the wafer 14 to be separated easily from the water film.

Figure 3:
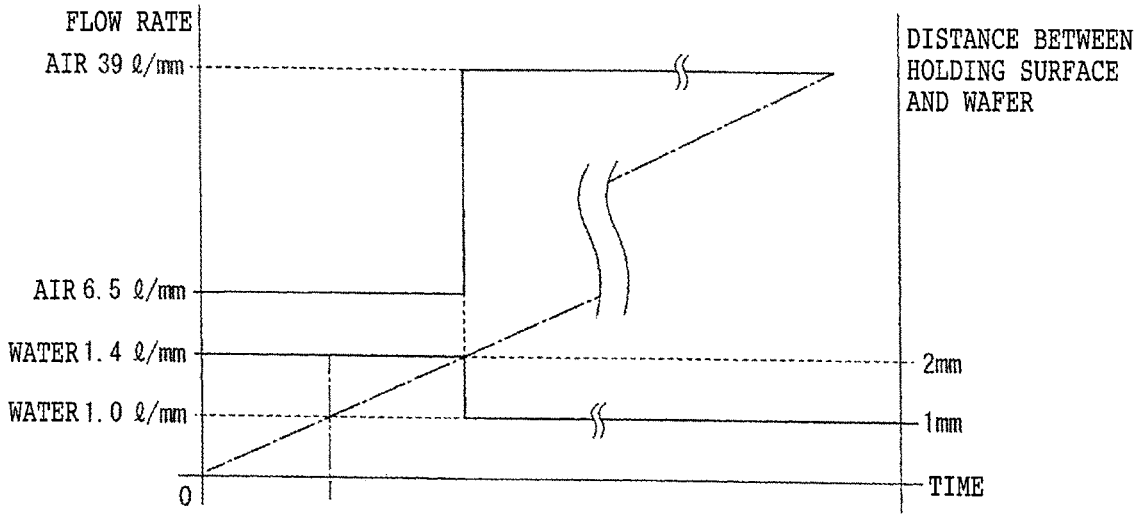
FIG. 3 is a graph illustrating the relation between the distance between a holding surface and a wafer spaced from the holding surface and the flow rates of water and air ejected from the holding surface.

FIG. 3 is a graph illustrating by way of example the relation between the distance between the holding surface 200 and the wafer 14 spaced from the holding surface 200 and the flow rates of water and air ejected from the holding surface 200. As illustrated in FIG. 3, when the distance between the holding surface 200 and the wafer 14 spaced from the holding surface 200 is in the range of 0 to 2 mm, the flow rate of air is controlled to be 6.5 liters/min and the flow rate of water is controlled to be 1.4 liters/min. When the distance between the holding surface 200 and the wafer 14 spaced from the holding surface 200 is in excess of 2 mm, the flow rate of air is controlled to be 39 liters/min and the flow rate of water is controlled to be 1.0 liters/min.

When the wafer 14 is spaced from the holding surface 200 by a predetermined distance, the shaft 66 is rotated to turn the arm 65 and position the wafer 14 held on the delivery pad 60 in the cleaning area 742, and the lifting and lowering mechanism 64 is actuated to lower the wafer 14 held on the delivery pad 60. The wafer 14 is now held on the upper surface of the spinner table 740. While the spinner table 740 is rotating, the cleaning fluid supply nozzle 741 ejects the cleaning fluid to the upper surface 140 of the wafer 14, cleaning away swarf and debris deposited on the upper surface 140 of the wafer 14. After the upper surface 140 of the wafer 14 has been cleaned, the robot 71 is actuated to store the wafer 14 back into the cassette 70.

With the processing apparatus 1, when the second delivery unit 62 is actuated to unload the wafer 14 that has been ground, from the holding surface 200, only water is ejected from the holding surface 200 to the lower surface 141 of the wafer 14 as it is spaced from the holding surface 200, forming a water film on the holding surface 200, and the water film raises the delivery pad 60 that is holding the wafer 14, to space the wafer 14 from the holding surface 200. The holding surface 200 supports the delivery pad 60 that is holding the wafer 14 with the water film interposed therebetween. Thereafter, the lifting and lowering mechanism 64 is actuated to lift the wafer 14 and space the wafer 14 away from the holding surface 200. Consequently, the wafer 14 can be spaced from the holding surface 200 safely without being ruptured.

Furthermore, after the wafer 14 is completely spaced from the holding surface 200, the lifting and lowering mechanism 64 lifts the wafer 14 while air is ejected to the water film from the holding surface 200. Since the larger the distance between the holding surface 200 and the lower surface 141 of the wafer 14 is, the larger the amount of air ejected from the holding surface 200 becomes, the wafer 14 can be lifted quickly from the holding surface 200.

The processing apparatus 1 is able to unload a wafer 14 being ground, safely and quickly from the holding surface 200, when a need arises to unload the wafer 14 being ground, from the holding surface 200, due to some trouble occurring during the process of grinding the wafer 14, for example. Particularly, a wafer having modified layers formed therein is more likely to be ruptured before it is ground to remove the modified layers. In a case where there is a need for the unloading of a wafer with modified layers formed therein from the holding surface 200 for some reason while the wafer is being ground on the processing apparatus 1 to remove the modified layers, the processing apparatus 1 can unload the wafer safely and quickly from the holding surface 200.

The present invention is not limited to the details of the above described preferred embodiment. The scope of the invention is defined by the appended claim and all changes and modifications as fall within the equivalence of the scope of the claims are therefore to be embraced by the invention.

What is claimed is:

1. A processing apparatus comprising:

a chuck table for holding a lower surface of a wafer on a holding surface thereof;

a processing unit for processing an upper surface of the wafer whose lower surface is held on the holding surface;

a delivery unit for unloading, from the holding surface, the wafer held on the holding surface; and a control unit;

wherein the chuck table includes:

a fluid communication passage providing fluid communication between the holding surface and a water supply source, a branching portion included in the fluid communication passage, an air fluid communication passage providing air fluid communication between the branching portion and an air supply source, a water flow rate regulating valve disposed in the fluid communication passage between the holding surface and the water supply source, for regulating a flow rate of water from the water supply source, and an air flow rate regulating valve disposed in the air fluid communication passage, for regulating a flow rate of air from the air supply source, and wherein the control unit:

controls the delivery unit to hold the wafer held on the holding surface, opens the water flow rate regulating valve to eject water from the holding surface, spaces the wafer from the holding surface and lifts the delivery unit holding the wafer, from the holding surface, with the water ejected from the holding surface, opens the air flow rate regulating valve to eject air from the holding surface when the lower surface of the wafer has been spaced in its entirety from the holding surface, and increases the flow rate of air as a distance between the holding surface and the wafer spaced from the holding surface increases by lifting of the delivery unit.

* * * * *